United States Patent [19]

McGill et al.

[11] Patent Number: 4,541,524

[45] Date of Patent: Sep. 17, 1985

[54] CASE PACKER

[75] Inventors: Robert W. McGill, Monroe Falls; Michael E. Winiasz, Lorain, both of Ohio

[73] Assignee: Figgie International, Richmond, Va.

[21] Appl. No.: 474,465

[22] Filed: Mar. 11, 1983

[51] Int. Cl.[4] ..... B65G 47/86

[52] U.S. Cl. ..... 198/470.1; 198/797; 53/250; 53/534

[58] Field of Search ..... 198/478, 479, 653, 694, 198/695, 696, 797; 53/534, 247, 250; 414/731, 735, 736, 416; 294/87 R, 87 A, 82 SH

[56] References Cited

U.S. PATENT DOCUMENTS

| | | | |
|---|---|---|---|
| 2,254,595 | 9/1941 | Carroll | 198/653 X |
| 2,611,612 | 9/1952 | Schmidt | 294/87.1 |
| 3,472,402 | 10/1969 | Priefert | 414/731 |
| 3,747,737 | 7/1973 | Brooke | 198/479 X |
| 4,106,612 | 8/1978 | Koerner | 198/479 |
| 4,169,621 | 10/1979 | McGill | 294/116 |
| 4,215,967 | 8/1980 | McGill et al. | 414/416 |

FOREIGN PATENT DOCUMENTS

| | | | |
|---|---|---|---|
| 713889 | 8/1954 | United Kingdom | 414/416 |

*Primary Examiner*—Joseph E. Valenza

*Attorney, Agent, or Firm*—Oldham, Oldham & Weber Co.

[57] ABSTRACT

Case packer apparatus including endless driven conveyor, article gripper, and carrier bars for the article gripper which depend therefrom and where the conveyor has a downwardly extending reach connecting a pickup station to an article deposit station, the carrier and gripper being operatively connected to the conveyor as case packer groups spaced longitudinally of the conveyor, and where leading and trailing cross bars engaging rows of leading and trailing articles carried by each article group are present and where positioning structure for the cross bars secure them to end carrier bars of and/or to end portions of the carriages of the case packer groups in different manners.

12 Claims, 17 Drawing Figures

CASE PACKER

TECHNICAL FIELD

The present invention particularly relates to case packers and to article packaging apparatus including conveyor means with gripper members thereon for being brought into engagement with articles at one location, grasping the articles and transmitting them to a case filling station for deposit of the articles into an empty case for case packaging action.

BACKGROUND ART

In case packing apparatus, it will be understood that large numbers of articles must be grouped and packaged quite rapidly by a mechanism that will function dependably without injury to the articles processed. In these packaging operations, normally streams of articles to be packaged are fed towards a loading station and, in one type of knbwn apparatus, the articles are formed into groups and are picked up as case filling groups by gripper means carried by an orbital article handling conveyor and are transferred to a case loading station where the article gripper means release and the articles are droppedinto empty cases which are fed to an operative position in association with the fixed orbit of the article handling conveyor. The article handling conveyor orbits in a vertical plane and has groups of dependent gripper means provided at longitudinally spaced portions of the drive conveyor for engaging groups of the articles to be packaged. The apparatus supplies, at a lower case filling station, empty cases and the driven conveyor moves the articles down to deposit the groups of articles into the positioned case after which the gripper means and conveyor move through the remainder of the orbit; a new case is brought into position for filling by articles carried by the next downstream group of gripper means etc.

One case unloading apparatus similar to that of the present invention is shown in U.S. Pat. No. 4,215,967. The present invention relates, in contrast, solely to a case loading apparatus and the apparatus is similar to that of the aforementioned patent except that it operates in one direction and is more like the apparatus shown in U.S. Pat. No. 4,294,057 which is on a case loader. However, in some instances the apparatus shown in U.S. Pat. No. 4,294,057 may have difficulty with accurately centering the articles to be packaged in the receiving recesses or spaces provided in the empty cases. It will be understood that the case and articles to be packaged are moving along at equivalent horizontal speeds as the articles are lowered into the cases for deposit therein. As the apparatus is functioning quite rapidly, say at the speed of approximately 20 or more cases per minute, it is important that the articles to be packaged be very accurately located in relation to the control or feed conveyor and to the case.

Quite a few article casers have been made using the bottle gripping devices as shown in U.S. Pat. No. 4,169,621. These bottle gripping devices have worked quite effectively in article uncasing actions. However, it has been noted that a more accurate positioning of the articles so that the engagement of the article grippers with the upper end of the articles, such as bottles, would facilitate case packing action where the larger diameter bottom end of the article must be accurately located openings provided in the case separator member positioned in the empty case. Also, in some instances the article gripper jaws as shown in such patent, in extending laterally beyond the main carrier frame of the gripper jaw, might interfere with the action of the other gripper jaws laterally adjacent each other.

DISCLOSURE OF THE INVENTION

It is the general object of the present invention to provide a new and improved case packer that will accurately control the positions of the articles of a group of articles on a transfer conveyor as they are deposited into an empty case.

Another object of the invention is to provide stabilizer bars or positioning members in engagement with end rows of groups of articles being carried by a transfer conveyor preparatory for deposit into an empty case and to position these stabilizer bars resiliently in the apparatus for engaging the groups of articles to be packaged.

Another object of the invention is to provide stabilizer bars in case packing apparatus of the type suspending the articles to be packaged by gripper means operably carried by a drive conveyor and to retain these suspended articles in relatively fixed vertical positions in relation to the conveyor and case as the conveyor approaches the case filling station.

Another object of the invention is to provide a mechanical article engaging means that has a good operative life and will aid in obtaining dependable case loading action.

Yet another object of the invention is to provide stabilizer means for groups of suspended articles in a case packer apparatus including a driven conveyor that supports and transfers the articles to be packaged and wherein the article stabilizer means engages the leading and trailing rows of articles in a group of articles and can be moved to inoperative positions where required in the orbit of the transfer and drive conveyor and to be brought to operative position when required as the articles are moved from a pickup station to the case filling station.

Another of the objects of the present invention is to provide an improved article gripper, or bottle gripping device having reduced lateral width, and to form an improved centering or locating action for a suspended bottle or similar article.

A further object of the invention is to utilize the position controlling members for carrier bars and article handling carriage components of prior art article handling apparatus in novel article control assemblies for transfer carriages in article handling apparatus.

Another object of the invention is to package articles fed to the apparatus in a series of continuous abutted streams rapidly and safely in carrier cases by a continuous motion apparatus.

Another object of the invention is to provide leading and trailing article engaging cross bars in a head carriage for a case packer with different position control means to aid in avoiding interference by the cross bars with other operative portions of the case packer as the head carriage in moved through an operative ofbit cycle, but yet to provide good article positioning action by such cross bars.

The foregoing and other objects and advantages of the invention will be made more apparent as the specification proceeds.

BRIEF DESCRIPTION OF THE DRAWINGS

Particular attention now is directed to the accompanying drawings wherein.

When referring to corresponding members shown in the drawings and referred to in the specification, corresponding numerals are used to facilitate comparison therebetween.

BEST MODE FOR CARRYING OUT THE INVENTION

Figure 1:
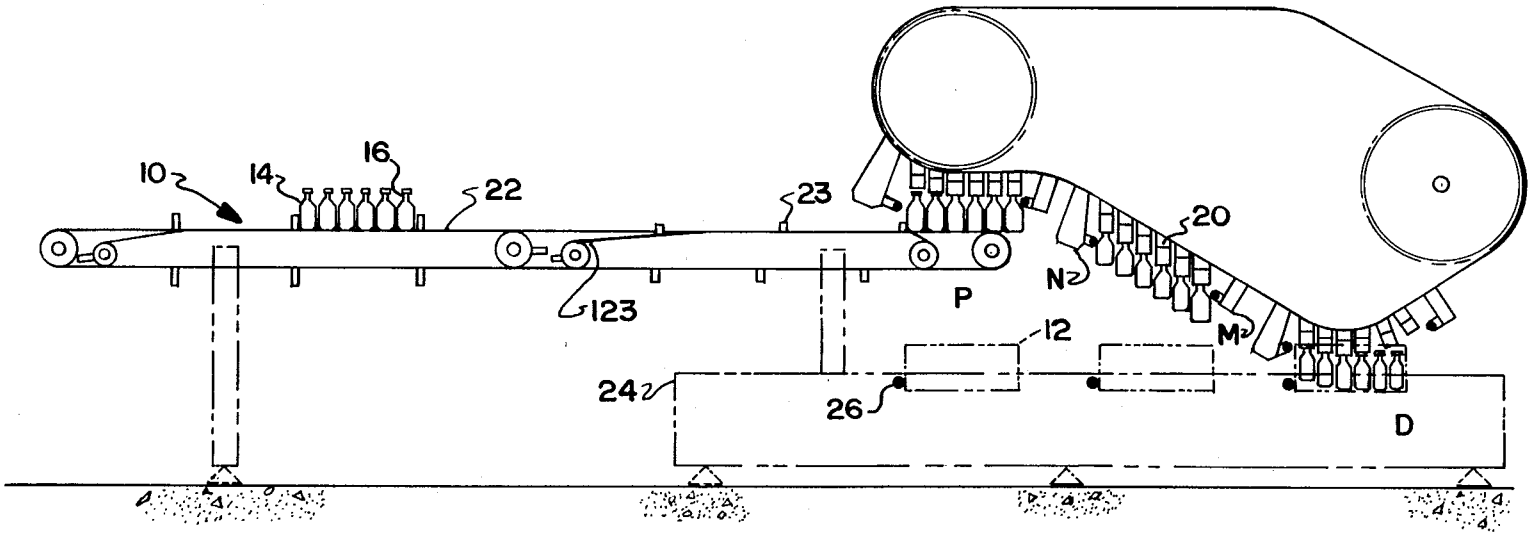
FIG. 1 is a side elevation, partially diagrammatic, of case packaging apparatus embodying the principles of the invention.

It should be understood in the description of the present invention that the articles to be packaged, as well as the cases are moved from upstream locations to downstream locations and this includes moving the articles from a case loading or pickup station indicated at P in FIG. 1 down to an article deposit station indicated at D in FIG. 1. The transfer of articles in this apparatus includes the movement of an endless driven conveyor means 10 through a fixed orbit in a vertical plane and wherein the driven conveyor means is adapted to pickup articles at the pickup station P and move them downwardly in a suspended or dependent position in relation to the driven conveyor 10 for deposit into an empty case 12. The case is brought to the case packing or article deposit station D simultaneously with a group of articles suspended from the driven conveyor 10 for deposit of the articles into the case 12 to fill the same in a well known manner as is usual in case packer operations.

It will be appreciated that the groups of articles being packaged have leading and trailing ends with the leading end being the row of articles that is the first row of the group moving in an downstream direction.

As indicated in FIG. 1 of the drawings, by the present invention, means M and N are brought into engagement with the leading and trailing rows of articles in the groups of articles being processed to aid in accurately locating such articles in suspended positions in relation to the driven conveyor 10 and maintaining these articles on vertical axes as they are moved downwardly in the fixed course of the conveyor orbit extending from the pickup station to the article deposit station D.

The articles being packaged, in this instance bottles 14 having reduced diameter necks 16, normally have metal caps or ribbed upper ends thereon and this facilitates their engagement with gripper members 20 provided in the apparatus of the invention.

It will be realized that the bottles 14 to be packaged are suitably arranged in case filling or packer groups by conventional means that may include stacking and positioning pins or fingers 23 provided on a conveyor means 123 positioned in association with an article feed conveyor 22 suitably positioned on a frame 24 of the apparatus at a upper portion thereof to supply abutted articles in case packer groups to the pickup station P. Likewise, the empty cases 12 are suitably provided in the apparatus in timed relationship to the feed of the groups of bottles 14 to the case packer station D by a conventional driven conveyor indicated at 26 that engages the cases for feed into and through the apparatus. The drives of these conveyors 10, 22, 123 and 26 are suitably correlated as indicated in the prior art patents referred to hereinbefore. Likewise, the articles are.arranged into case filling groups on the article conveyor 22 by conventional means such as the article engaging finger system and conveyor means 123 disclosed in expired U.S. Pat. No. 3,190,434.

Figure 2:
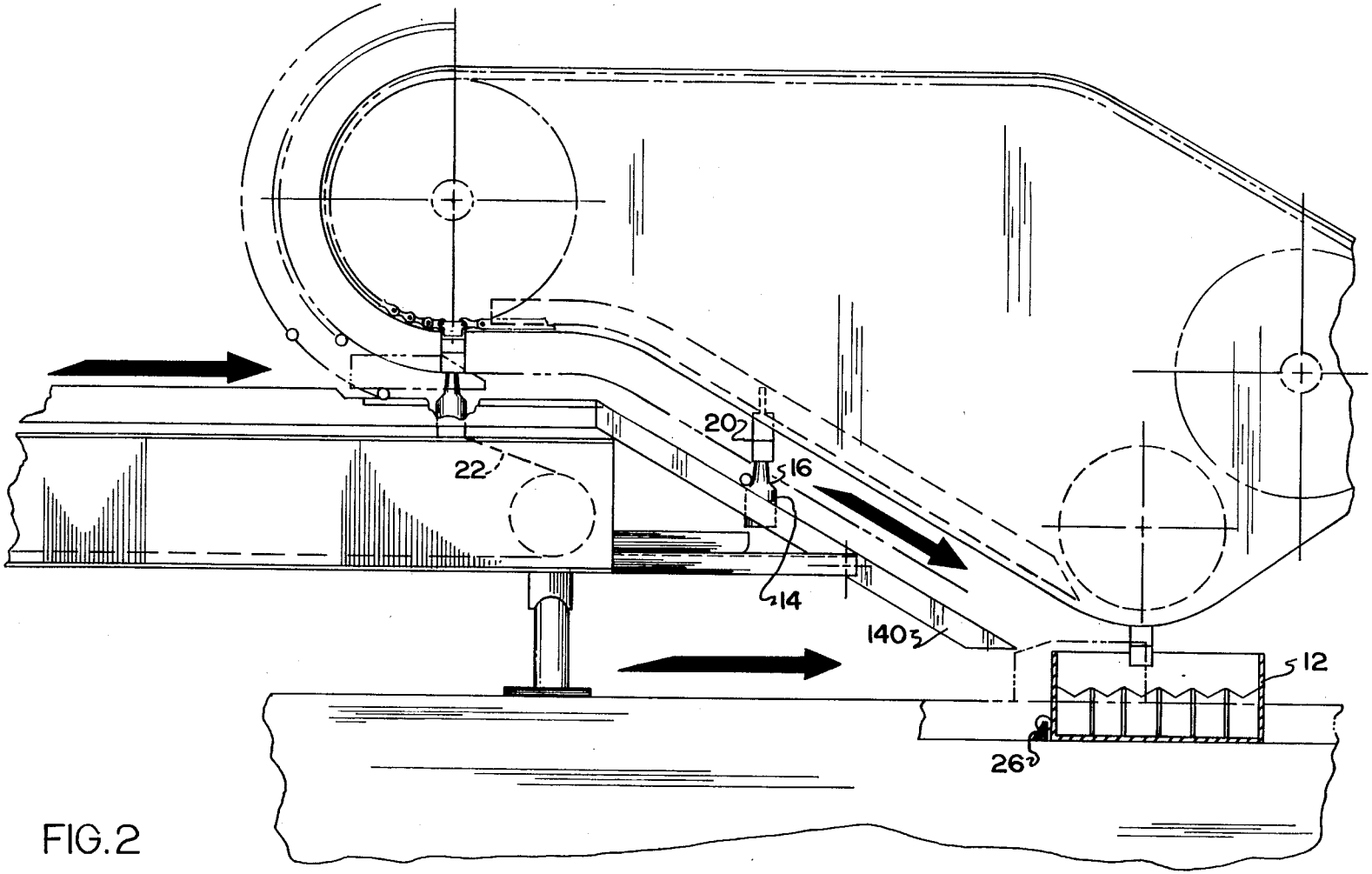
FIG. 2 is an enlarged fragmentary diagrammatic side elevation of part of the apparatus of FIG. 1.
Figure 3:
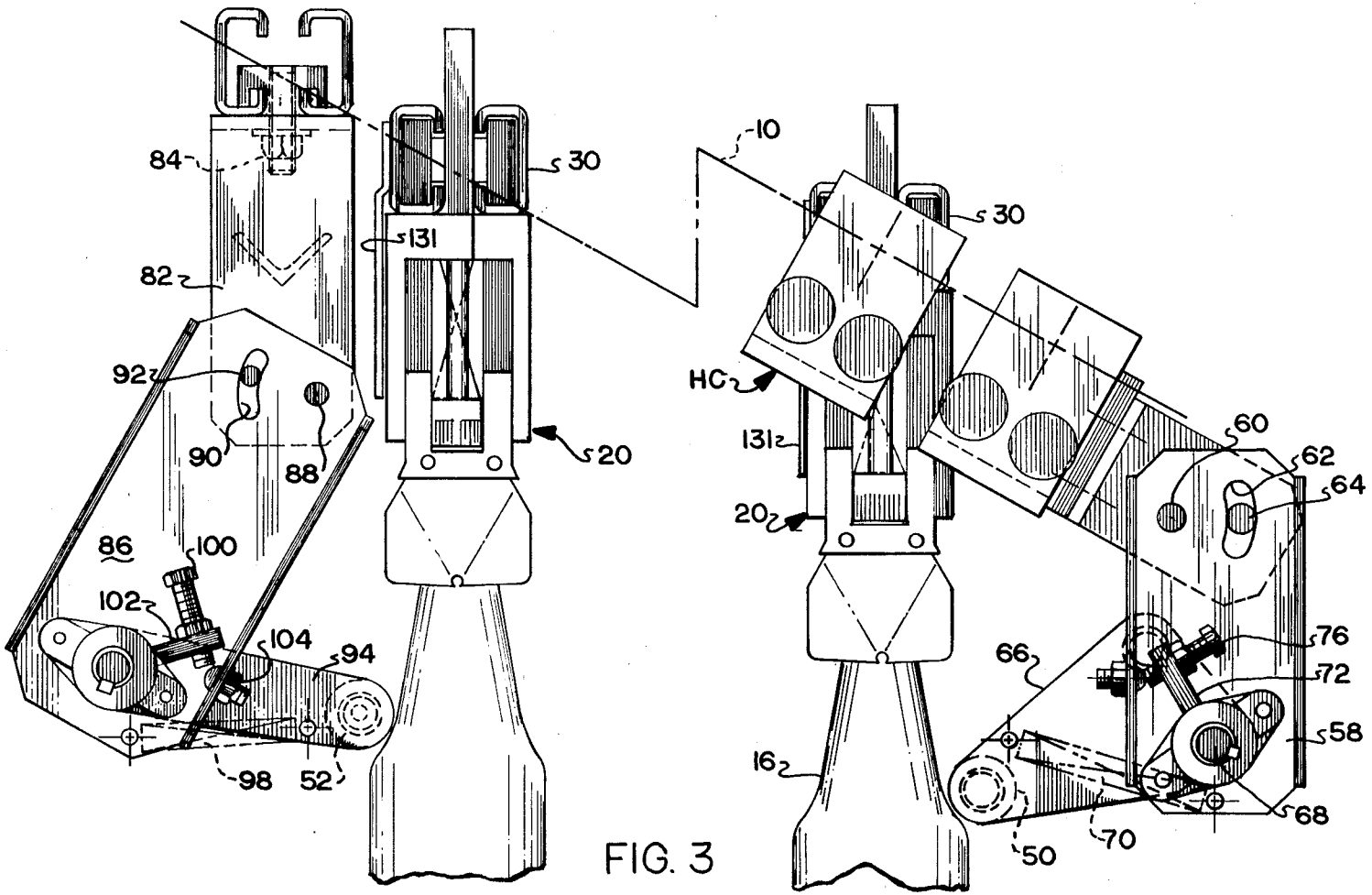
FIG. 3 is a side elevation, partially broken away and shown in the section, of the carriage for a case packer group, partially broken away.

As previously indicated, the apparatus of the invention is generally the same as that disclosed in U.S. Pat. No. 4,215,967 and in such patent FIGS. 2 and 3 show typical pantograph means used for connecting a plurality of the cross bars in the apparatus and units for case filling action. Thus, the present invention, a plurality of carrier bars 30 are provided in each case filling group and these carrier bars 30 mount a plurality of the gripper members or means 20 in laterally associated relationship on each carrier bar 30. The drive chains for the pair of driven conveyors 10 connect to these case packer groups or head carriages HC in a manner of such U.S. Pat. No. 4,215,967, but in addition, each of the carriages includes end cross bar means including a leading cross bar 34 that is secured to and extends between a pair of the mounting means or brackets 36,36 a pair of which are provided at both the leading and trailing ends of each head carriage for an article packer group. Also a pair of rollers 38,38 are operatively carried on the mounting means 36 for engaging control cam track means 39 operatively positioned on the frame of the apparatus. Additionally the cross bar 34 has a control arm 40 extending therefrom as in the previously known apparatus, while the mounting means 36 has an offset plate 42 forming a portion thereof; the bracket 36 including a block member 44 to engage with one or the other of the pair of driven conveyors forming the driven conveyor means 10 to form the article packer groups head carriage but to permit adjustment in the size thereof by the pantograph means connecting the carrier bars 30 and end bars into units. The control arm 40 has cam follower roll 140 secured thereto for engaging a control cam tracks 41 for control of the attitude of the leading carrier bar 34.

The control arm 40 is fixedly secured to the carrier or finger bar 30 and extends therefrom as in the previously known apparatus to control the attitude or position of this carrier bar 30 as the conveyor orbit. The mounting bracket 36 has pivotal engagement with the positioning shaft 31 for the bar 30.

Figure 4:
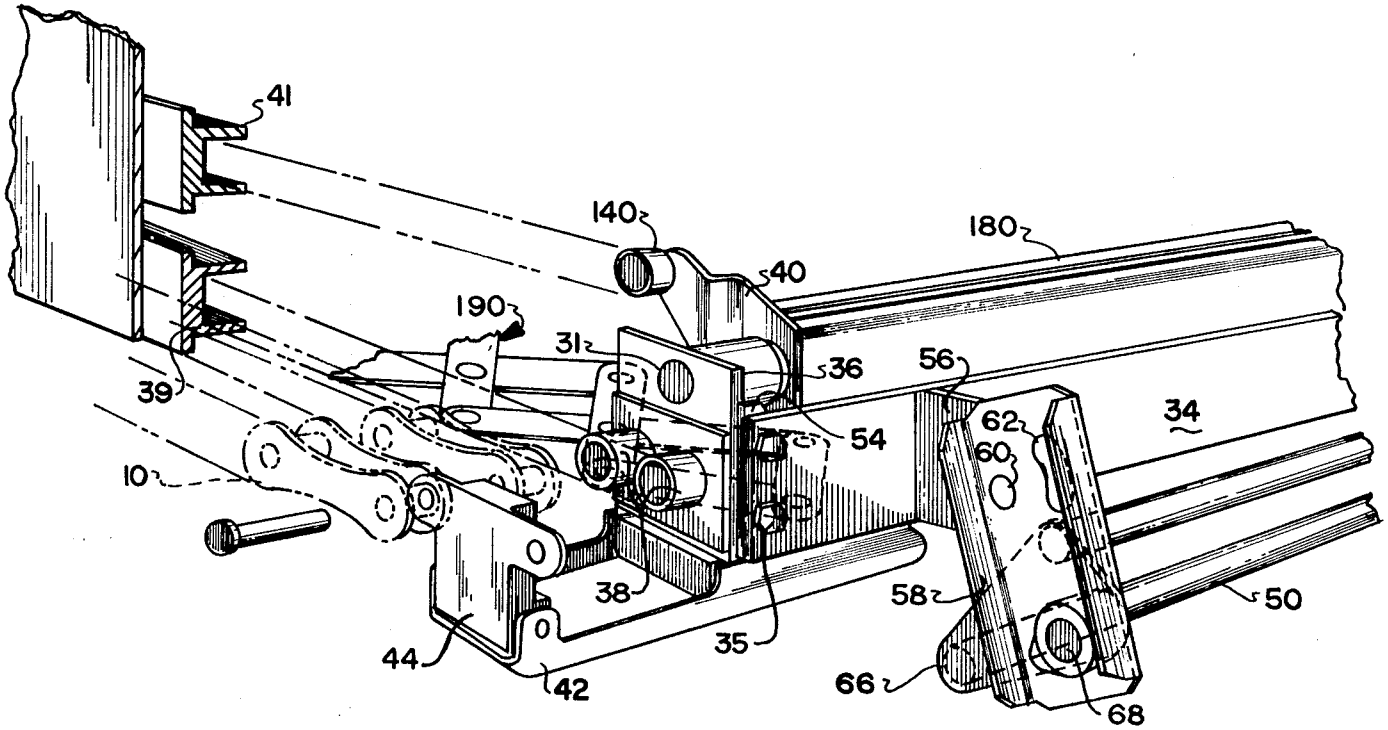
FIG. 4 is a fragmentary perspective view of the case packer group of FIG. 3 taken from the leading end of its carriage.

Note in FIG. 4 that the leading tie or cross bar 34 is fixedly secured to the pair of the brackets 36,36 on opposite lateral margins of the apparatus and such bar can be secured to the bracket 36 or to reinforcing plate 54 associated therewith in any desired manner, as by bolts 35. Additionally, a positioning flange 56 is secured, as by welding, to this cross bar 34 and extends in a downstream direction therefrom.

Figure 5:
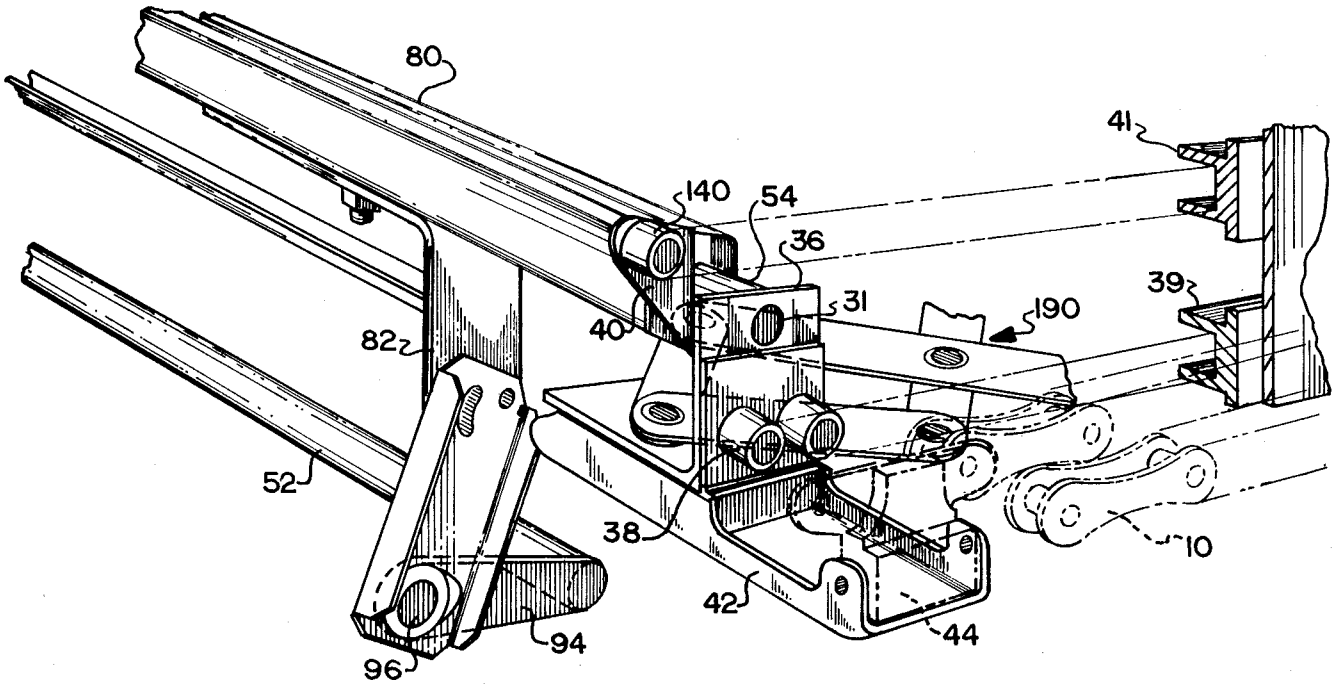
FIG. 5 is a perspective view. like FIG. 4, of the trailing end of the case packer group of Fig. 3.

FIGS. 4 and 5 best show the construction of the novel means for positioning article engaging leading and trailing cross bars 50 and 52 for engaging, respectively, the row of leading and of trailing articles in each of the article forming groups.

As indicated in FIG. 4, the leading cross bar 50 is operatively carried by the leading end carrier bar 34 and it extends transversely between the driven conveyors 10 and mounting brackets 36 to aid in forming operative groups of article support and transfer carriages. A dependent mounting device or plate 58 is pivotally secured to and depends from the flange 56 by a pin or rivet 60. An arcuate slot 62 if also formed in this mounting plate 58 and a bolt or equivalent member 64 extends through it and the flange 56 to control and adjust the dependent position of this mounting plate in relation to the fixed downward extending course of the driven conveyors 10. This aids in controlling the position of the suspended articles 14 to maintain them on vertical axes while in transit. To further this goal, a positioning arm 66 is pivotally secured to the lower end of the mounting plate 58 as by a positioning pin or stub shaft 68, one of which is provided on each of the mounting plates 58 adjacent the lateral margins of the apparatus. The article engaging cross bar 50 is suitably secured to an upstream extending end of the arm 66 to extend between the arms 66 and be positioned for engaging the neck or other portions of the suspended bottles 14.

So as to mount the cross arm or bar 50 resiliently and avoid problems in processing the articles grouped if a malfunction occurs, the arm 66 is resiliently drawn in toward the lower end of the dependent mounting plate 58. To this end a spring 70 is secured in tension between a portion of the arm 66 and a part of the mounting plate 58. To control the resilient position of this cross bar 50, a control bar 72 is suitably secured to the stub shaft 68 on which the arm 66 is mounted. Such control bar 72 has a suitable lock screw 76 operatively secured thereto for engaging with an associated portion of the mounting plate or a member thereon to limit the pivotal position of the bar 72 and hence the positioning arm 66 in the apparatus. Hence adjustment of the lock screw 76 will determine the ultimate accurate position and angular relationship of the mounting arm 66 to the dependent mounting plate 58 and associated members.

At the opposite end of the head carriage for the grouped articles, the carrier bar means provided for this trailing end of the grouped articles includes a conventional gripper member positioning cross bar 80 which has a downwardly extending bracket 82, FIG. 3, suitably secured thereto, as by a cap screw means 84 which engages with the lower surface of the cross bar 80 and the bracket 82 to rigidly position this bracket in a dependent position. A positioning plate 86 is secured to the lower end of this bracket 82 in dependent relation by a pin or rivet 88 and arcuate adjustability is permitted between these two members by providing a slot 90 in the plate 86 engaging a retainer bolt or screw 92 secured to the associated mounting bracket 82 whereby a controlled pivotal positioning movement is provided for this plate 86 in the apparatus.

Of course there are brackets 82 and associated means at both ends of the cross bar 80.

A resilient adjustable position is provided for the trailing cross bar 52 by a carrier arm 94 that is pivotally secured at one end to the positioning plate 86 as by a stub shaft 96 or the like. A spring 98 resiliently pulls the free end of the carrier arm 94 that is pivotally secured at one end to the positioning plate 86 as by a stub shaft 96 or the like. The spring 98 resiliently pulls the free end of the carrier arm 94 in towards the upper portion of the positioning plate 86 but such movement is controlled by means of a set screw 100 like the set screw 76 previously described in association with the leading end of the head carriage. The set screw 100 is operatively associated with a control plate 102 affixed to the stub shaft 96 and extending substantially radially therefrom whereby such set screw 100 can be adjusted in relation to the control plate 102 to engage with an associated member or portion of the positioning plate 86 as by a screw 104 thereon to physically limit arcuate movement of the arcuate member and position of the control plate 102 in relation to the longitudinal axis of the positioning plate 86. Hence the resiliently determined position for the cross bar 52 and its operative relationship with the suspended bottle 16 at the trailing end or row of bottles or articles in the case packer group formed in the apparatus of the invention can be controlled.

It will be seen that both the carrier or positioning arms 66 and 94 are resiliently positioned so that they can move inwardly of the head carriage but that their motion outwardly or axially outwardly of the article forming group is limited by the set screw means provided. Hence, the cross bars can be set to operatively engage the dependent articles and keep the leading and trailing cross bars retaining these bottles suspended on vertical axes and preventing movement of end bottles outwardly of the grouped bottles. Thus, by the correlation of drive of the conveyor for the case and the conveyor 10, the bottles can be accurately positioned, retained on vertical axes and be deposited accurately in relation to preselected recesses or areas provided in the article receiving case.

Figure 16:
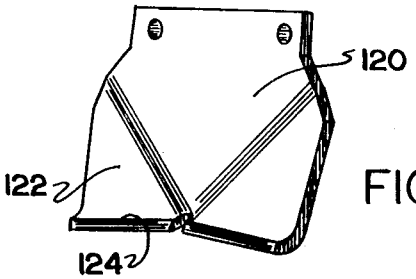
FIG. 16 is a perspective view of a metal article gripper jaw forming a part of the gripper means of FIG. 14.
Figure 17:
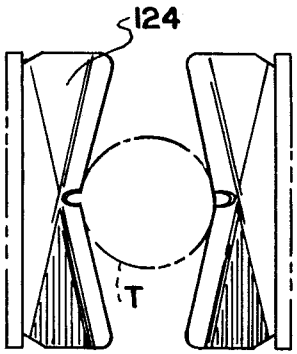
FIG. 17 is a partially diagrammatic bottom plan view of the gripper jaw means of FIG. 14 indicating a neck of an article engaged by the gripper Jaw means.
Figure 14:
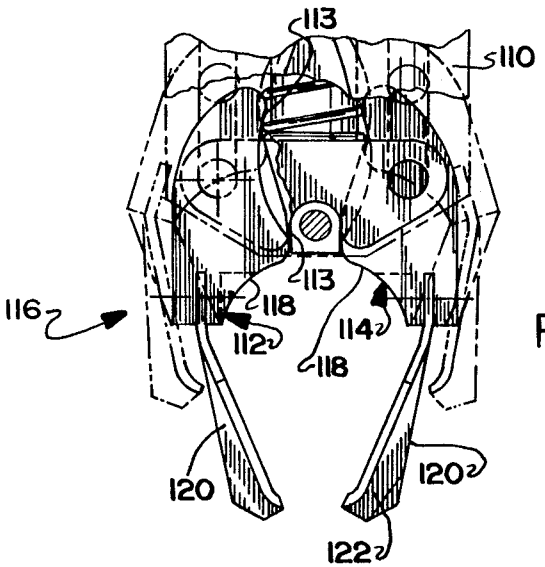
FIG. 14 is a fragmentary side elevation of the article gripper means forming part of the apparatus of the invention.
Figure 15:
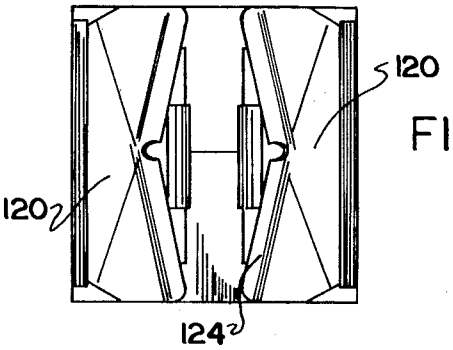
FIG. 15 is a bottom plan view of the article gripper means of FIG. 14.

FIGS. 14–17 show more details of the article gripping devices used in practice of the invention and in this instance, an open centered frame 110 is provided for this article gripper which is of the same operative construction as the device shown in U.S. Pat. No. 4,169,621 but only part of the unit is shown. However, as a feature of the present invention, the lower portion of this article gripper device has reduced lateral dimensions even when operative in relation to prior article gripper devices. Hence, a pair of gripper jaw means 112 and 114 are operatively mounted on the frame of this device and are carried by a gripper jaw carrier member 116 that is suitably positioned on the frame for movement on a vertical axis. This pair of gripper jaw means 112 and 114 are pivotally carried by this gripper jaw member 116 at the lower portion thereof and they protrude downwardly from the side plates of the frame. The gripper jaw carrier member is movable vertically on the frame and the jaws have cam follower surfaces 113 provided thereon for engaging cam means on the frame to control the positions of the gripper jaws re article engaging and disengaging action and with the position of the gripper jaws being controlled by relative movement between the frame and the gripper jaw carrier member. In this instance, the gripper jaw means 112 and 114 each includes an upper section 118,118 and a metal plate 120,120 lower section carried by the section 118 and extending downwardly therefrom. These metal plates 120 can be suitably secured to the lower ends of the gripper jaw sections 118 in any conventional mannner as by rivets or equivalent means and they are positioned laterally inwardly spaced from the outer portions of the upper sections 118 of the gripper jaws. The metal plates 120 slant laterally inwardly of the gripper member slightly from top to bottom thereof but they also have laterally inwardly turned side edge portions 122 that terminate in inwardly turned lower edge flanges 124 as shown in FIG. 16. These edge flanges 124 facilitate the gripper jaw plates 120 engagement with the head or top portion of an article to be packaged. Furthermore, the inwardly turned edge flanges 124 slant slightly in towards the center portion of the gripper jaw itself and this aids in centering the neck or top of a bottle indicated at T in FIG. 17 in the gripper jaws. Naturally this aids in accurately positioning the article as suspended for deposit down into a case. It should be noted that the gripper jaw metal plates 120,120 when the jaws are moved to normal release position, do not protrude laterally appreciably further than the projection of the lateral width of the gripper jaw member 20 itself. Thus, there will be no interference of this gripper jaw member 20 and its frame in operation in relation to laterally associated gripper jaw members of equivalent design.

For a completely released position of the gripper jaws, which only occurs under unusual conditions and is not a normal operative position, the gripper jaw plates 120 may move out beyond the lateral margins of the frame of the article gripper device.

Figure 6:
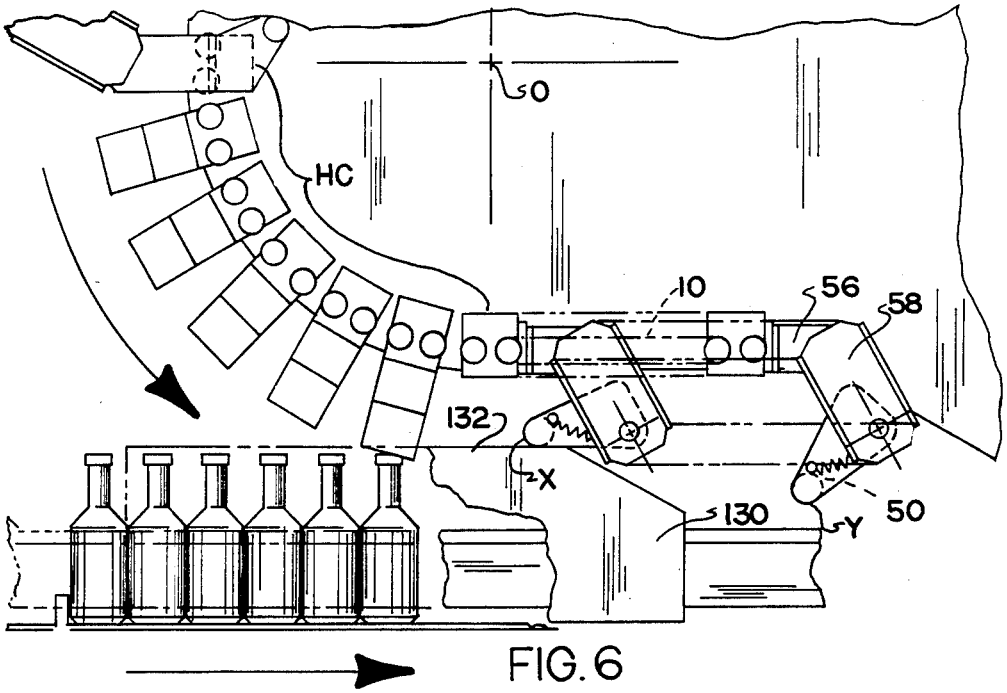
FIG. 6 is a fragmentary, partly diagrammatic side elevation of the apparatus at the article pickup station.
Figure 7:
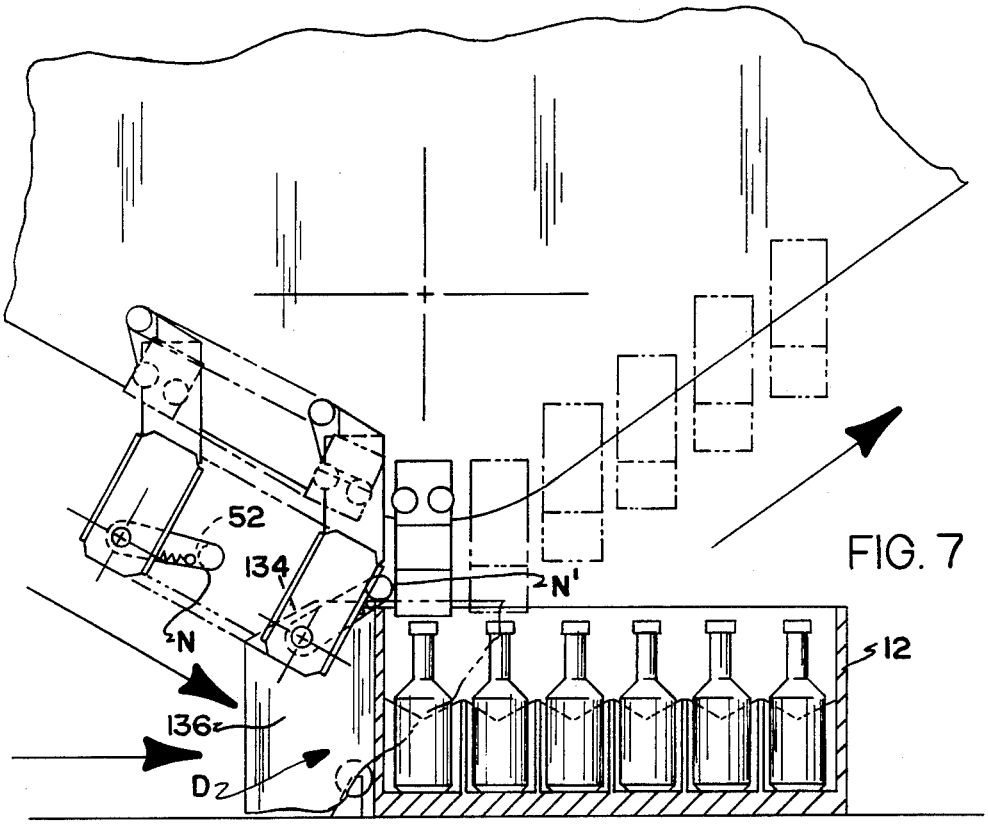
FIG. 7 is a fragmentary, partly diagrammatic side elevation of the trailing end of the carriage for an article group at the article deposit station.

FIGS. 6 and 7 best show how these leading and trailing stabilizer or cross bar members 50 and 52 are moved out of any disruptive engagement with the bottles supplied or the cases 12 into which the articles are to be deposited. Thus, FIG. 6 diagrammatically represents how this leading cross bar 50, as the article grippers are brought down towards engagement with the bottles, such cross bar will hit a cam plate 130 that is suitably operably positioned on the frame at the article pickup station P. Such cam plate 130 is of such a length longitudinally of the apparatus and it has an operative upper surface 132 of a proper height so that the cross bar 50 will hit the cam plate 130 at its edge 132 as the conveyors 10 move the head carriage HC through a downwardly and forwardly extending arc centered at 0. At that time bracket 58 is pointing downstream but the cross bar 50 would contact the leading bottles if not moved upwardly above the bottles as indicated at x. As the conveyor means 10 advance, the cross bar 50 reaches position Y and is ready to move into engagement with the bottles as the conveyors start to move down towards the case packer station.

FIG. 7 shows how the trailing cross bar 52 will strike an inclined cam track portion 134 formed on a cam plate 136 and be moved upwardly thereby at the case packer station. The cross bar 52 has a normal position N but is moved up to the position indicated at $N^1$ as the case 12 and bottles are moved downstream. The cross bar 52 is lifted up beyond the top of the case 12 so that such cross bar will not interfere with the deposit of the trailing row of articles into the case 12. The spring members associated with the cross bars 50 and 52 will bring them back into operative association with the head carriage for engaging articles to be transported thereby.

FIG. 7, it should be noted, is at the article deposit station D so the cam plate 136 is suitably operably positioned at that area.

Figure 8:
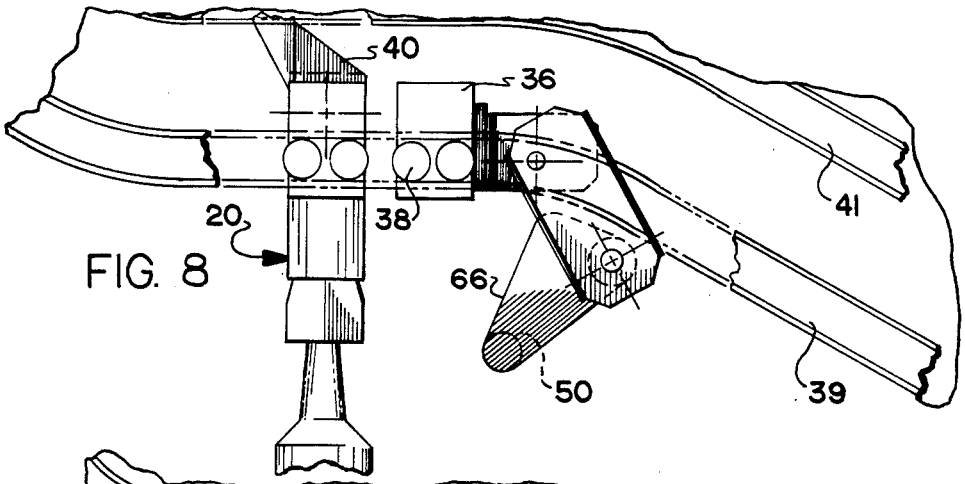
FIG. 8 is a fragmentary, partly diagrammatic side elevation of the leading cross bar assembly as it is being moved through the article pickup station.
Figure 9:
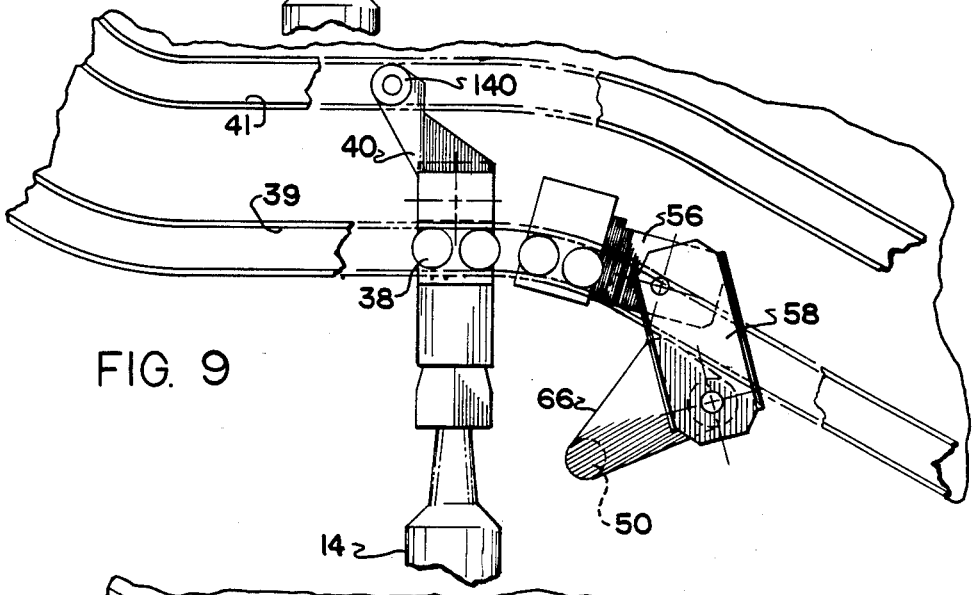
FIG. 9 is a view, like FIG. 8 but with the leading cross bar and associated means being advanced slightly downstream.
Figure 10:
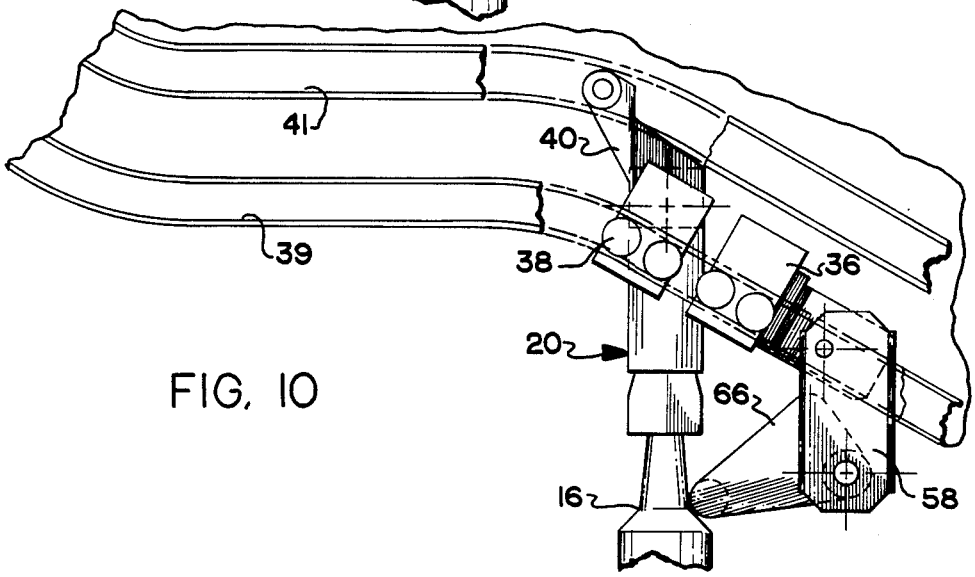
FIG. 10 is a fragmentary diagrammatic side elevation like FIG. 8 but showing the leading cross bar further along in its operative cycle and engaging the transported articles.

To further describe the operation of the cross bars 50 and 52 see FIGS. 8 through 13 that show the progressive positions of the bars as they move to and through the article pickup and deposit stations. As the leading cross bar 50 is to be brought into engagement with the leading row of transported articles, its action at the article pickup station is shown since it is closest to interference action with the articles or case at that area. Thus it is will be noted that the cross bar 50, when operatively positioned, is in fixed association with the cross bar 34 and the continuous cam tracks 39, these tracks function to change the attitude of the flange 56 and thus of the front bar 34 to swing the front bar 34, flange 56 and the front leading cross bar 50 down quickly after the articles 14 have been picked up, which action is best indicated in FIGS. 8–10 of the drawings. Such action occurs, of course, as the carriage starts to leave the article pickup station and starts to move downwardly in the fixed orbit for the conveyor means 10.

Figure 11:
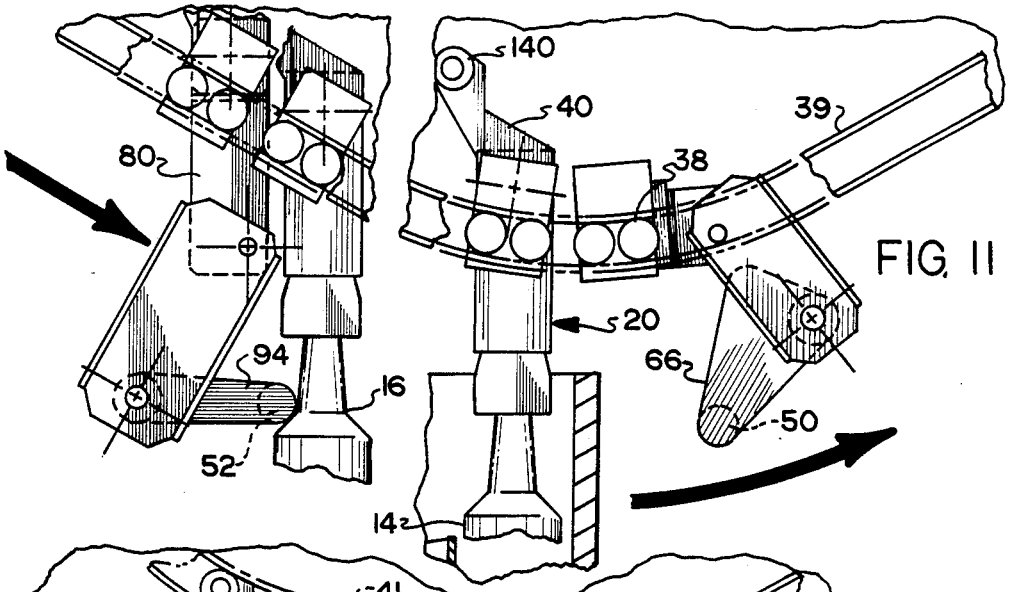
FIG. 11 is a fragmentary side elevation, partly diagrammatic of the trailing end of the carriage and the trailing cross bar coming in to the article deposit station.
Figure 12:
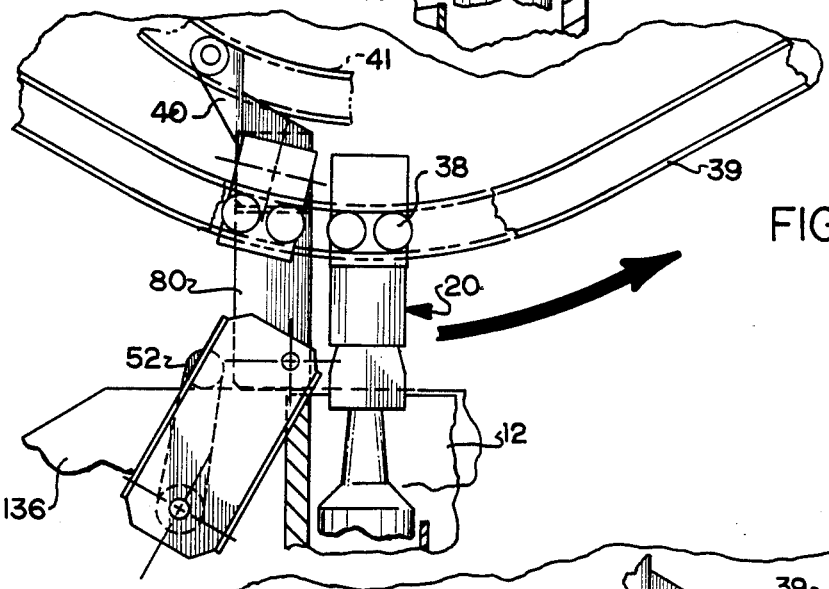
FIG. 12 is a fragmentary side elevation, like FIG. 11 but with the trailing cross bar being advanced downstream slightly.
Figure 13:
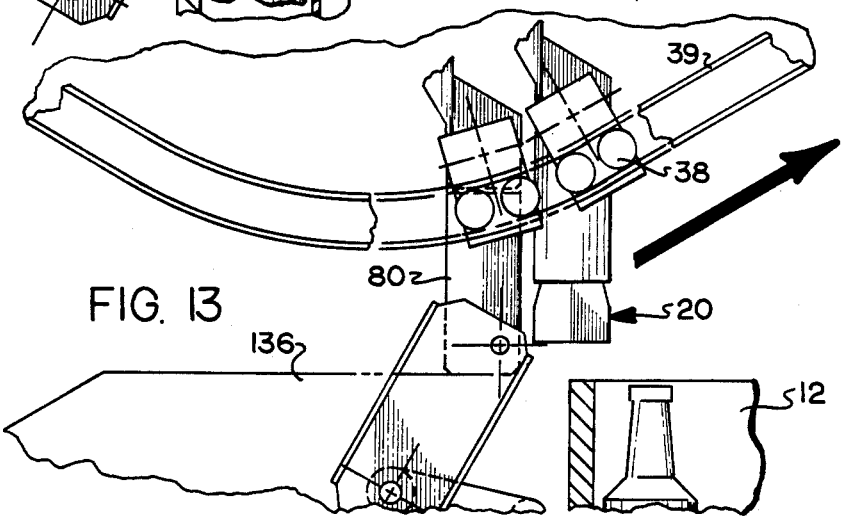
FIG. 13 is a fragmentary partly diagrammatic side elevation like FIG. 11 of this trailing cross bar and its positioning means as it is starting to move from the article deposit station.

With reference to the trailing bar, 52, it is operatively carried by the finger or cross bar 80, FIG. 5, that is at the trailing end of the head carriage of the apparatus and cross bar 80 has a pair of the edge brackets 36,36 suitably and operatively secured thereto by the shafts 31 as indicated. However, the finger bar 80 also has one of the control arms 40 fixedly secured thereto to have its position controlled thereby. This control arm 40 engages the pair of cam tracks 41 to control the pivotal relation of the finger bar 80 and members fixedly secured thereto to the brackets 36. As the positioning bracket 82 is fixedly secured to the finger bar 80, the position of this bracket is controlled by the cam tracks 41 engaging the roller 43 on the control arm 40 and maintaining the gripper members 20 on vertical axes as done in the prior art. This is as indicated in the drawings and the prior apparatus on which the present apparatus is based had the function of maintaining these members 20 on vertical axes at important times in the conveyor orbit, especially as in the present instance as they are moved from the pickup station to the article deposit station. This control action also. aids in keeping the trailing cross bar 52 from striking the case 12 immediately after article deposit as shown in FIGS. 11–13. The cross bar 52 will strike the cam plate 136 and be moved upwardly being retained in such position, as in FIG. 12, until the case 12 has been moved downstream away from the article deposit area and the cross bar 52 and its positioning means have started to be moved upwardly in the conveyor orbit.

Another control function of the invention is that in the carriage heads, the various finger bars 30 are provided with guide plates 131 as shown in FIG. 3. The guide plates 131 extend vertically downwardly of the finger bars 30 and are secured to the trailing side of the finger bars to extend down and engage the one margin of the gripper members 20 to prevent any upstream pivotal movement of these gripper members 20 in the finger or carrier bars 30 since there is some freedom of movement provided therebetween. Any such looseness in the assembly makes it more difficult to get a good accurate positioning of suspended articles for case filling deposit action.

FIG. 2 of the drawings shows that a plurality of guide plates 140 extend downwardly in the apparatus with the downward extending course of article travel and these guides 140 can be adjusted laterally with relation to each other to vary with the width of the articles being handled to keep such articles aligned on a longtiudinal flow axis as they move between adjacent pairs of these guides 140 to aid in retarding undersired movement thereof.

It will be understood that the control arms 40 in the present head carriages are of the same construction and action as in the prior art patents referred to hereinbefore.

The cross bars 50 and 52 have good adjustability due to the positioning means provided therefor. Thus, as shown in FIG. 3, these bars can be brought into engagement with desired, suitable portions of the articles or bottles 14, as the base of the necks 16. This aids in insuring that any swinging forces or actions that tend to be started in the suspended articles will be primarily exerted on substantially horizontal axes. The springs 70 and 98 and the other positioning means are so designed as to retain these cross bars in effective engagement with the suspended articles to prevent undersired movement of the bottles 14 and to obtain accurate article case action.

It will be seen that the self-centering action of the gripper jaw plates 120 further aids in obtaining excellant control of the position of the article transported.

As previously indicated, the head carriage of the present invention is constructed and functions as in the prior art patents referred to before. But the end carrier bars 80 and 180 have been added to the head carriages and connect to the pantograph means 190 in known manners as indicated in FIG. 4.

Parts of the apparatus have been omitted in some views for clarity.

The apparatus of the invention adds desirable, novel and improved functions to the art and achieves the objects set forth hereinbefore.

While in accordance with the Patent Statutes, only the best mode and preferred embodiment of the invention has been presented and described. It is to be understood that the invention is not limited thereto or thereby. Accordingly, for an appreciation of the true scope of the invention, reference should be made to the attached claims.

What is claimed is:

1. A case packer apparatus including an endless driven conveyor means, article gripper means, and carrier bars for said article gripper means, said conveyor means having a downwardly extending reach connecting a pickup station to an article deposit station, said article gripper means depending from said carrier bars as said conveyor means moves said carrier bars from a pickup station to an article deposit station, and said carrier bars and gripper means being operatively connected to said conveyor means with carriage means and forming case packer groups spaced longitudinally of said conveyor means, the improvement of leading and trailing end carrier means positioned on each of said case packer groups, leading and trailing cross bars in said case packer groups for engaging the rows of leading and trailing articles carried by each case packer group, and positioning means on said leading and trailing end carrier means respectively engaging and positioning said cross bars to secure them to end portions of each said group, and to suspend them below said carrier bars to directly engage neck areas of articles engaged by said gripper means.

2. In a case packer apparatus as in claim 1, the improvement comprising said positioning means for said leading cross bar including a mounting flange carried by said leading end carrier means adjacent each end thereof and protruding forwardly therefrom, and a dependent mounting device secured to each said mounting flange, said leading cross bar being secured to and extending between said mounting devices.

3. In a case packer apparatus as in claim 1, where said positioning means for said leading cross bar includes an overhanging dependent unit adjacent each lateral margin of said carriage means, and an upstream directed arm is pivotally carried on each of said units and said cross bar is secured to said arms and extends therebetween.

4. In a case packer as in claim 1, where said positioning means for said trailing cross bar includes dependent devices secured to said trailing end carrier means, positioning arms pivotally secured to said dependent devices and depending therefrom, and a mounting arm for said trailing cross bar pivotally adjustably engaging said positioning arms and extending downstream therefrom whereby said cross bar can be brought into operative engagement with the trailing row of articles in a group and aid in maintaining them vertically suspended from said conveyor.

5. In a case packer as in claim 1, where said positioning means each include spring means urging said leading and trailing cross bars inwardly of each case packer group to engage only articles in the leading and trailing rows of the suspended articles.

6. In a case packer as in claim 5, where a plate is secured to an upstream side of each of said carrier bars and depends therefrom to overlap upper portions of the said article gripper means to limit upstream movement of said article gripper means in relation to said carrier bars.

7. A case packer apparatus including en endless driven conveyor means having a fixed orbit in a vertical plane, article gripper means, carrier bars for said article gripper means operatively connected to and movable with said conveyor means, said conveyor means having a downwardly extending reach connecting a loading station to an article deposit station, said article gripper means depending from said carrier bars when said conveyor means moves said carrier bars from said loading station to said article deposit station, a carriage means for said carrier bars and gripper means operably connected to said conveyor means to position the gripper means as case packer groups spaced longitudinally of said conveyor means, said gripper means positioning articles to be packaged in transversely extending rows in said article groups, said carriage means including end carrier bars and edge brackets, a pair of said edge brackets being pivotally secured to each of said end carrier bars, cross bars for engaging the rows of leading and trailing articles in an article group, positioning means for said cross bars to secure them to said carriage means of each said group, and said positioning means including said trailing cross bars being fixedly secured to a said end carrier bar and said leading cross bar being fixedly secured to said edge brackets whereby the positions of said leading and trailing cross bars can be differently controlled as said conveyor means moves through its orbit, thus the controlled positions and actions of the cross bars can be varied.

8. A case packer apparatus as in claim 7, where pantograph means form a part of said carriage means and secure all of said carrier bars thereto, said end carrier bars carrying no gripper means thereon, said positioning means for said trailing cross bars including a mounting member fixedly secured to its said end carrier bar and extending downwardly therefrom, and said leading cross bar being fixedly secured to said edge brackets by its said positioning means that includes forwardly extending members operably carried by said edge brackets.

9. A case packer apparatus as in claim 7, where said article gripper means include gripper jaws with flanged lower edges that slant inwardly from both edges to provide an article centering support action, said positioning means for said cross bars are adjustable in two different arcuate directions whereby said cross bars can be brought into engagement with the suspended articles at desired portions thereof to aid in preventing movement thereof longitudinally of said carriage means, and other parts of said positioning means engage said cross bars to prevent movement thereof axially outwardly of said head carriage.

10. In a case packer as in claim 1, a fixed cam plate positioned at said pickup station to engage said leading cross bar and move it up to avoid interference with article pickup by said gripper means.

11. In a case packer as in claim 1, a fixed cam plate positioned at said article deposit station to engage said trailing cross arm and lift it avoid engagement with a case in which articles are being deposited.

12. A case packer apparatus including an endless driven conveyor means, article gripper means, and carrier bars for said article gripper means, said conveyor means having a downwardly extending reach connecting a pickup station to an article deposit station, said article gripper means depending from said carrier bars as said conveyor means moves said carrier bars from a pickup station to an article deposit station, and said carrier bars and gripper means being operatively connected to said conveyor means with carriage means and forming case packer groups spaced longitudinally of said conveyor means, the improvement of leading and trailing end carrier means positioned on each of said case packer groups, leading and trailing cross bars in said case packer groups for engaging the rows of leading and trailing articles carried by each case packer group, and positioning means on said leading and trailing end carrier means respectively engaging and positioning said cross bars to secure them to end portions of each said group, said positioning means positioning said cross bars for pivotal movement upwardly of said case packer groups, spring means engaging said cross bars to urge them downwardly of said case packer groups, means to limit the downward pivotal movement of said cross bars, and said cross bars extend transversely of said case packer groups.

* * * * *